US011470899B2

(12) United States Patent
Parrish

(10) Patent No.: US 11,470,899 B2
(45) Date of Patent: Oct. 18, 2022

(54) ARTICLES AND DEVICES FOR INTERCHANGEABLE PATCHES

(71) Applicant: R. Michael Parrish, Toronto (CA)

(72) Inventor: R. Michael Parrish, Toronto (CA)

( * ) Notice: Subject to any disclaimer, the term of this patent is extended or adjusted under 35 U.S.C. 154(b) by 0 days.

(21) Appl. No.: 17/105,766

(22) Filed: Nov. 27, 2020

(65) Prior Publication Data

US 2021/0161228 A1 Jun. 3, 2021

Related U.S. Application Data

(60) Provisional application No. 62/941,757, filed on Nov. 28, 2019.

(51) Int. Cl.
*A41D 27/08* (2006.01)
*A42B 1/004* (2021.01)

(52) U.S. Cl.
CPC ..... *A41D 27/08* (2013.01); *A42B 1/004* (2013.01)

(58) Field of Classification Search
CPC ..... A42B 1/004; A42B 1/24; A42B 1/242; A42B 1/245; A42B 1/248; A41D 27/08; A41D 27/085; A44C 17/0216; Y10T 24/13; G09F 21/02; G09F 21/023; A42C 5/00; A43B 23/24
USPC ..... 2/244, 246, 209.13; 24/1, 20.5 R, 3.1, 24/3.11, 482, 530; D2/895; 36/136
See application file for complete search history.

(56) References Cited

U.S. PATENT DOCUMENTS

| | | | | |
|---|---|---|---|---|
| 4,611,355 | A | 9/1986 | Galanto et al. | |
| 4,776,043 | A | 10/1988 | Coleman | |
| 5,253,368 | A | 10/1993 | Blake | |
| 5,359,733 | A | 11/1994 | Brannon et al. | |
| 5,359,734 | A | 11/1994 | Rathburn | |
| 5,373,568 | A | 12/1994 | Kato | |
| 5,509,144 | A | 4/1996 | Soergel et al. | |
| 5,632,047 | A | 5/1997 | Van den Heuvel | |
| 5,918,316 | A | 7/1999 | Nathanson et al. | |
| 5,924,139 | A | 7/1999 | Van Den Heuvel | |
| D417,063 | S | 11/1999 | Henning | |
| 6,058,573 | A * | 5/2000 | Silver | A41D 27/08 24/105 |
| 6,519,799 | B1 | 2/2003 | Bartholomew | |
| 7,243,377 | B2 | 7/2007 | Ashy | |
| 8,869,312 | B2 | 10/2014 | Tuohy et al. | |
| 10,578,258 | B1 * | 3/2020 | Patton | F21V 33/0008 |
| 2001/0034894 | A1 | 11/2001 | Godfrey et al. | |
| 2008/0263839 | A1 * | 10/2008 | Stillwell | A43B 3/0078 24/713.6 |
| 2010/0107317 | A1 * | 5/2010 | Wang | A42B 1/08 2/411 |

(Continued)

FOREIGN PATENT DOCUMENTS

WO WO-2016032149 A1 3/2016

*Primary Examiner* — Jameson D Collier

(57) ABSTRACT

A device for interchanging a patch on an article, the device including a base component configured to contact an inner surface of the article; a curved component configured to contact an outer surface of the article wherein the curved component is switchable between an engaged state and a disengaged state, and wherein the curved component is configured to receive the patch in the disengaged state and attach the patch to the article in the engaged state; and a connector configured to extend through the article to fasten the curved component to the base component.

19 Claims, 13 Drawing Sheets

(56) References Cited

U.S. PATENT DOCUMENTS

| | | | | |
|---|---|---|---|---|
| 2012/0222331 | A1* | 9/2012 | Blunden | A43B 23/24 36/102 |
| 2017/0273413 | A1* | 9/2017 | Katz | A44C 17/0216 |
| 2017/0354208 | A1* | 12/2017 | Park | A44B 1/34 |
| 2018/0049500 | A1 | 2/2018 | Richardson | |

* cited by examiner

ARTICLES AND DEVICES FOR INTERCHANGEABLE PATCHES

FIELD

This invention relates to articles with interchangeable patches. More specifically, the invention relates to devices for interchanging patches on articles.

BACKGROUND

It has become popular to adorn various articles such as baseball style caps, carry bags, lunchboxes with artwork depicting for example an individual's preferred sports team or to reflect an affiliation a person feels toward a certain brand. Typically, these artworks come in the form of printed logos, embroidered patches, or other such permanent applications. One article is generally associated with one type of artwork and for multiple artworks consumers are therefore required to purchase multiple articles with different artworks they prefer.

SUMMARY

According to an aspect of the specification, a device for interchanging a patch on an article is provided, including a base component configured to contact an inner surface of the article; a curved component configured to contact an outer surface of the article wherein the curved component is switchable between a natural state and an inverted state, and wherein the curved component is configured to receive the patch in the inverted state and attach the patch to the article in the natural state; and a connector configured to extend through the article to fasten the curved component to the base component.

According to another aspect of the specification, an article with interchangeable patch is provided, including a body having an inner surface and an outer surface; a patch disposed at the outer surface of the body; and a device to interchangeably secure the patch against the outer surface of the body.

BRIEF DESCRIPTIONS OF THE DRAWINGS

Embodiments are described with reference to the following figures, in which.

DETAILED DESCRIPTION OF THE EMBODIMENTS

It may be desirable for articles to exhibit a variation of the chosen artwork without requiring purchase of additional articles. This will save cost and time of the consumers. Conventional articles with interchangeable patches use fasteners such as hook and loop, VELCRO™, a type of hook and loop fastener, snaps, ZIPLOC™ a type of resealable plastic linear fastener, seals, however those heretofore known and utilized result in poor visual outcome and do not meet aesthetic standards set by the traditional permanent application of artwork.

Additionally, fasteners such as hook and loop, VELCRO™, snaps, ZIPLOC™ seals have limitations such as exhibiting early wear and tear, showing frayed edges, difficult to align or being cumbersome to manage. Thus, there exists a need for interchangeable patch mechanisms in articles which result in good aesthetics for example making the patch look like it is traditionally embroidered on article and at the same time are easy to handle.

The present invention provides a device for interchanging a patch on articles such as baseball style caps, knit hats, carry bags, lunchboxes etc. The device has a base component configured to contact an inner surface of the article; a curved component configured to contact an outer surface of the article and a connector configured to extend through the article to fasten the curved component to the base component. The curved component is switchable between a natural state and an inverted state and is configured to receive the patch in the inverted state and attach the patch to the article in the natural state. The inversion mechanism of the curved surface of the device allows easy replacement of artwork from the outer surface of articles and provides a seamless closure that once secured becomes difficult to discern its presence versus a traditionally attached/sewn artwork. Such a device with an inversion mechanism may be appealing to users, particularly the youth, having a satisfying and interactive manner of interchanging and "popping" the device in and out to interchange the patches.

Figure 1:
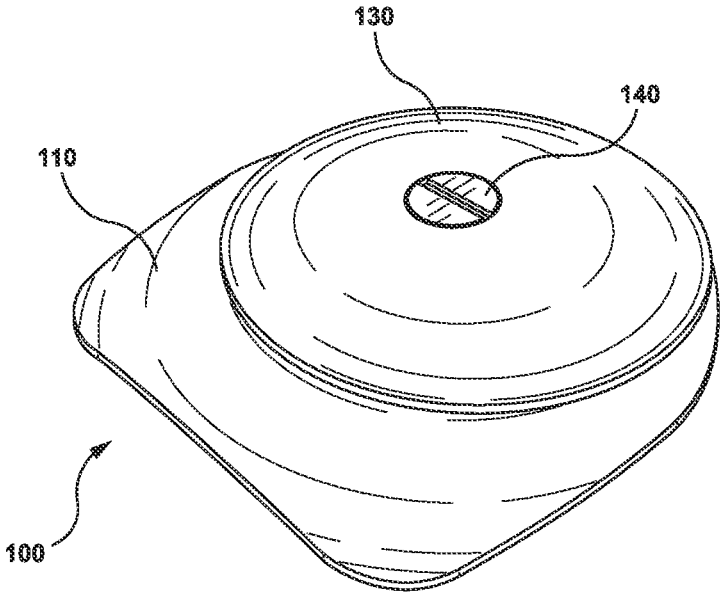
FIG. 1 is a perspective view of a device for interchanging a patch, according to a non-limiting embodiment.

FIG. 1 shows a perspective view of a device 100 for interchanging a patch. The device 100 includes a base component 110 to anchor the device 100 to an article, a curved component 130 to receive the patch and secure the patch against the article, and a connector 140 to fasten the base component 110 and the curved component 130.

The base component 110 anchors the curved component 130 and the device 100 to the article to keep the device 100 and hence the subsequently attached patch in a designated position on the article. Preferably, the base component 110 is configured to provide a rigid surface against which the curved component 130 may be biased when it is in the engaged state (as described further below). That is, the base component 110 may have a similar shape and size as the curved component 130. In some further examples, the base component 110 may have a similar shape and a larger size than the curved component 130. The base component 110 may include plastics, metals, wood, combinations of the above, or the like. In some embodiments, the base component 110 may include holes on its surface to allow for reduced weight and breathability. In the present example, the base component 110 has a curved surface; however, it is contemplated that in other examples, the base component 110 may have a profile which is configured to match the profile of an article to which the device 100 is attached. Hence, if the article has a flat surface, the base component 110 may have a flat surface.

The curved component 130 is configured to be disposed at an outer surface of the article to allow replacement and interchangeability of patches on the article. In particular, the curved component 130 is switchable between an engaged state and a disengaged state. In the disengaged state, at least an outer edge of the curved component 130 is moved away from the base component 110 to allow the curved component 130 to receive the patch. In the engaged state, the outer edge, and preferably the whole curved component 130 cooperates with the base component 110 to substantially trap a portion of the patch between the curved component 130 and the base component 110 to retain the patch on the article. The curved component 130 is therefore resilient and pliable enough so that it can repeatedly switch between the engaged state and the disengaged state. For example, the curved component 130 can include plastics, metals, rubbers, combinations of the above, and the like. Specifically, in some examples, the curved component 130 may be formed of polypropylene having a memory to return to its preformed state and generating the tension to securely retain the patch on the article in engaged state.

The curved component 130 additionally cooperates with the base component 110 to reduce the impact the curved component 130 generates when it is switched between the engaged and disengaged state. Specifically, the base component 110 is resistant to any impact on the article or the curved component 130 in the engaged and disengaged states. For example, when the curved component 130 changes from a disengaged state to an engaged state on application of pressure to attach the patch to the article, the base component 110 does not deform or invert in response to the impact. Similarly, when the curved component 130 changes from an engaged state to a disengaged state on application of pressure to receive the patch and attach it to the article, the base component 110 does not deform or invert in response to the impact.

Preferably, the curved component 130 has a natural curvature and has an engaged state, wherein the curved component 130 is aligned with its natural curvature, as well as a disengaged state, wherein the curved component 130 is inverted against its natural curvature. In the present example, while the curved component 130 is relatively stable in its disengaged state and may be maintained in the disengaged state, because it is inverted against its natural curvature, the curved component 130 is biased towards the engaged state and its natural curvature. In other examples, the curved component 130 may not have a "natural" curvature and may be equally or substantially equally stable in each of the engaged and disengaged states. The curvature of the curved component 130 allows the patch to firmly rest on the article and allows for aesthetics similar to a traditionally embroidered patch on article.

The connector 140 fastens the base component 110 and the curved component 130. In the present example, the connector 140 is located approximately in the middle of the curved component 130 and the base component 110. In other examples, the connector 140 may be located proximate an edge of the curved component 130 and/or the base component 110. More generally, the connector 140 fastens the curved component 130 to the base component 110 such that the curved component 130 is switchable between the engaged state and the disengaged state. The connector 140 may be configured to releasably fasten the curved component 130 and base component 110. For example, the connector 140 may be a rivet projecting through the base component 110 and curved component 130 securing the two components together. Additionally, in some examples, the connector 140 may be integrally formed with the curved component 130 and/or the base component 110. For example, each of the curved component 130 and the base component 110 may include an extension which interact with one another to form the connector 140 and to fasten the curved component 130 and the base component 110 together. For example, the extensions may be male and female screw components, knob and socket components, or other suitable connectors.

Figure 2A:
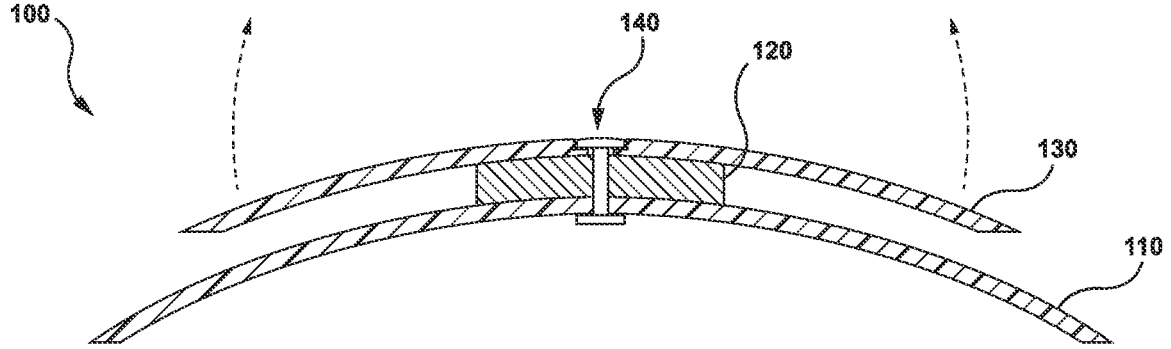
FIG. 2A is a side view of a device for interchanging a patch, according to a non-limiting embodiment.
Figure 11:
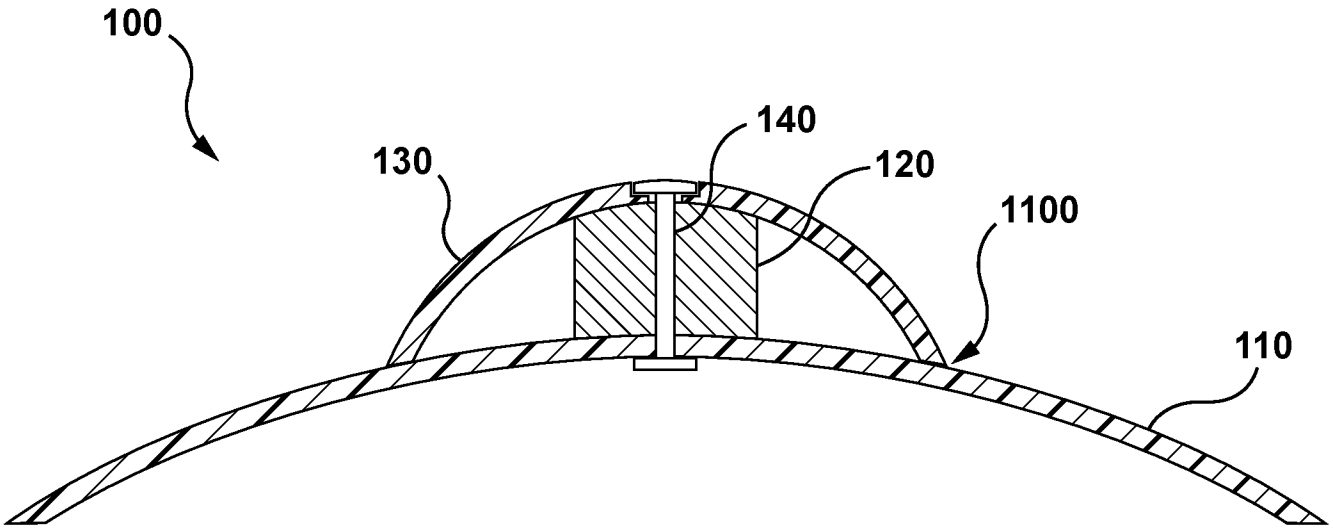
FIG. 11 is cross sectional side view of the device for interchanging a patch according to another non-limiting embodiment.

FIG. 2A shows a side view of the device 100 with curved component 130 in engaged state. In the engaged state, at least the edges, and preferably the whole curved component 130 create a small space in which to trap a portion of the patch. Thus, when a portion of the patch is disposed between the curved component 130 and the base component 110, the portion is trapped and hence in the engaged state, the device 100 works to retain the patch on the article. In the presently illustrated example, the radius of curvature of the curved component 130 and the base component 110 is substantially the same. In other examples, the radius of curvature of the curved component 130 may be smaller than the radius of curvature of the base component 110. That is, the curved component 130 may be more curved than the base component 110. In such examples, in the engaged state, the outer edges of the curved component 130 are biased towards the base component 110 through the connector 140. Foe example, as can be seen in FIG. 11, the curved component 130 and the base component 110 may have different radii of curvature, and hence, when the curved component 130 is fastened to the base component 110 in the engaged state, an outer edge 110 of the curved component 130 is biased against the base component 110. In some embodiments, such as the example illustrated in FIG. 2A, the device may further include a spacer 120 to space the base component 110 and curved component 130 at predefined distance.

The curved component 130 in the engaged state provides the tension to hold the patch against the article. This is possible as the curved component 130 is biased against the base component 110. This provides stability to the patch and the device 100. When a new patch needs to be attached to the device 100 or an old patch needs to be interchanged by the user, the curved component 130 can be switched to an inverted position and the disengaged state by inverting the edges of the curved component 130, as depicted by the dashed arrows in FIG. 2A.

Figure 2B:
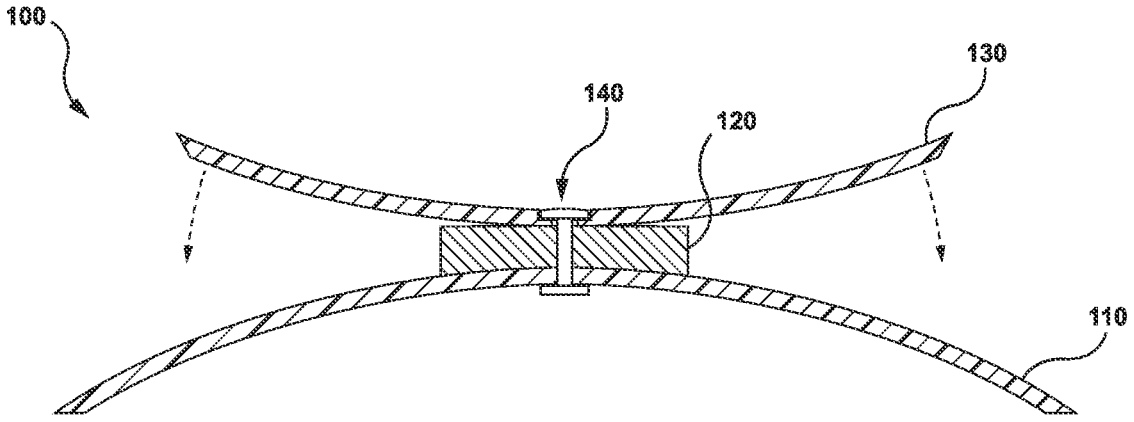
FIG. 2B is a side view of the device of FIG. 1 with the curved component in the disengaged state, according to a non-limiting embodiment.

FIG. 2B shows a side view of the device 100 with the curved component 130 in disengaged state. The curved component 130 can be brought to the disengaged state from the engaged state by application of pressure on the surface of the curved component 130. In the disengaged state, the edges of the curved component 130 project in the direction opposite to the base component 110 and the outer surface of the article (not shown), this creates space to remove the trapped portions of the patch to release the patch from the device and/or to insert portions of the patch into the space between the curved component 130 and the base component 110 to allow the device 100 to receive the patch. The size of the curved component 130 allow it to stay inverted in the disengaged state for a considerable time until the patch is received on the curved component 130. In a preferred embodiment, the diameter of the curved component is about 2.5 inches. In other examples, the diameter of the curved component 130 may be between about 2 inches to about 4 inches. After the patch is received by the curved component 130, the curved component 130 is brought back to the engaged state (FIG. 2A) by the application of pressure on the surface of the curved component 130. Specifically, the edges of the curved component 130 may be reverted to their position proximate the base component 110, as depicted by the dashed arrows in FIG. 2B.

The curved component 130 may further be configured to match the shape of the patch. This allows for the patch to be securely placed on the curved component. Due to the secure placement of patch on the curved component 130, the patch does not slip out from the curved component 130 and affect the aesthetics of the overall article. In the presently illustrated figures, a round shape of the curved component and the patch is depicted. However, other possible shapes may be squares, rectangles, ovals, or stars. In such examples, the curved component 130 is preferably shaped to bias the outer edge or perimeter of the curved component 130, and therefore the corresponding patch, towards the base component 110 to retain the patch on the device 100 and the article. The biasing of the outer edge towards the base component 110 further serves to provide an aesthetic that the patch may be integrally formed with the article on which the patch is secured. Custom shapes can also be adapted to accommodate the needs of those wanting to display variations of sports team logos, animated characters, brands or other such interests. The curved component may accordingly be customized to suit the needs of the user.

Figure 3:
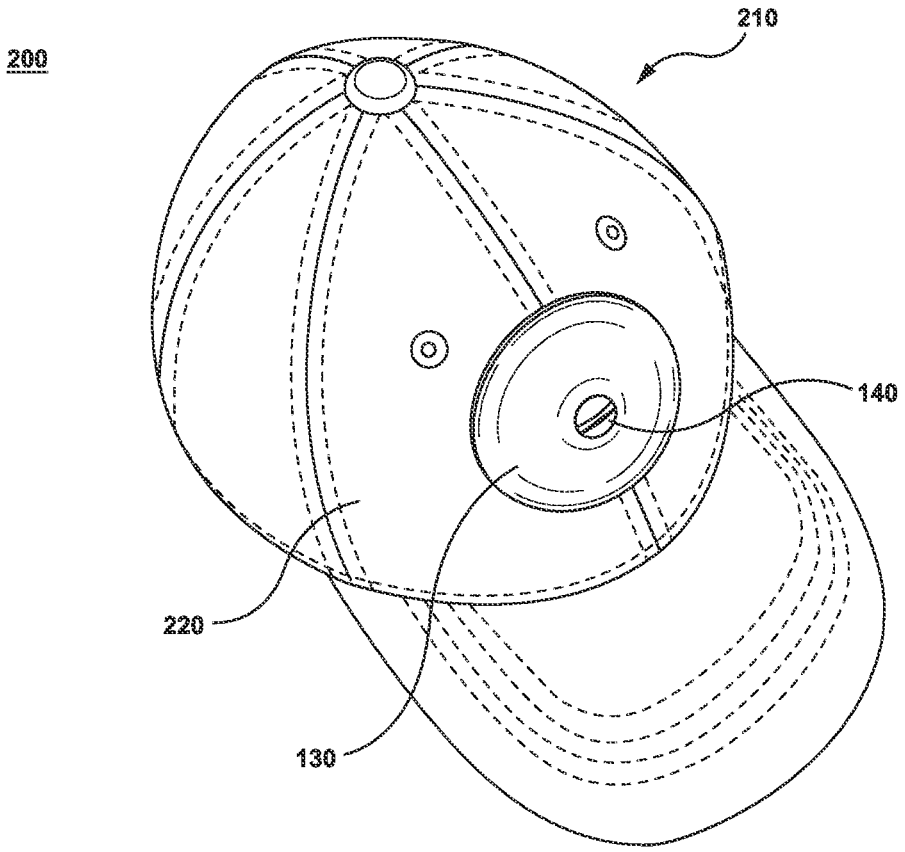
FIG. 3 is a perspective view of a hat employing the device of FIG. 1 with the curved component in engaged state, according to a non-limiting embodiment.

FIG. 3 depicts a perspective view of a hat 200 employing the device 100. The hat 200 includes body 210, outer surface 220, inner surface (not visible), device 100 for interchanging a patch including the base component 110 (not visible), curved component 130 in natural state, and connector 140.

The base component 110 is in contact with the inner surface of the hat (not visible), the curved component 130 is placed on the outer surface 220 of the hat 200 and the connector 140 extends through the hat 200 to fasten the base component 110 and curved component 130.

As can be seen, the curved component 130 and/or the base component 110 may be designed to match the profile of the article to which it is attached. For example, in this case, the curved component 130 is designed to match the curvature of the outside of the hat 200.

The curved component 130 is in the engaged state and the edges of the curved component 130 touch the outer surface of the hat 200. The shape and size of the curved component 130 allow it to be securely attached to the hat 200. In the engaged state, the curved component 130 may attach a patch (not shown) to the hat 200.

Figure 4:
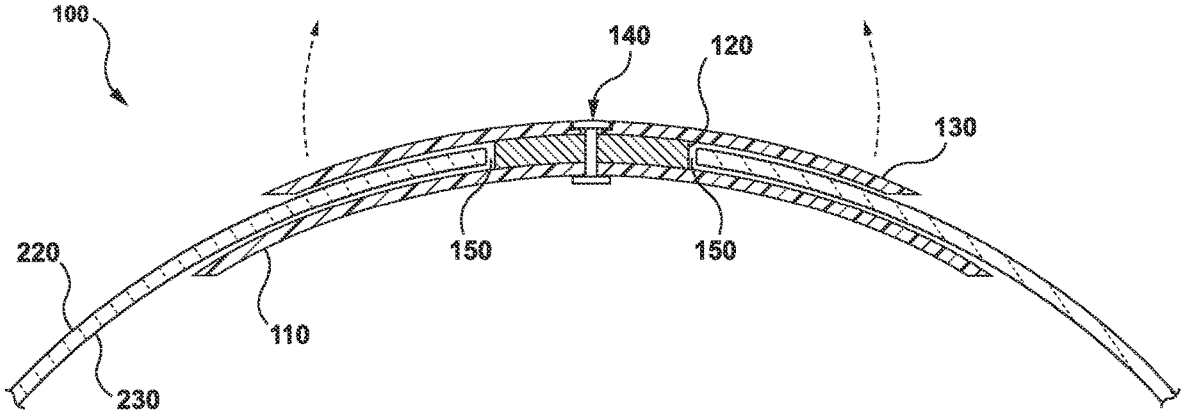
FIG. 4 is a cross sectional side view of the hat employing the device of FIG. 1, according to a non-limiting embodiment.

FIG. 4 shows a cross sectional side view of the hat 200 employing the device 100. The hat 200 further comprises an aperture 150 to create gap for the connector 140 to extend through the body 210 of the hat 200. The device 100 may optionally further include the spacer 120 to space the base component 110 and curved component 130 at predetermined distance. Specifically, the spacer 120 may have substantially the same diameter as the aperture 150 so that the device 100 does not move around in the aperture 150. The spacer 120 may further be about the thickness of the body 210 so that the device 100 does not compress the body 210 of the hat 200 too tightly when it is fastened by the connector 140. That is, the predefined distance at which the base component 110 and the curved component 130 are spaced apart may correspond to the thickness of the body 210 of the hat 200 (or other article on which the device 100 is employed).

Figure 5:
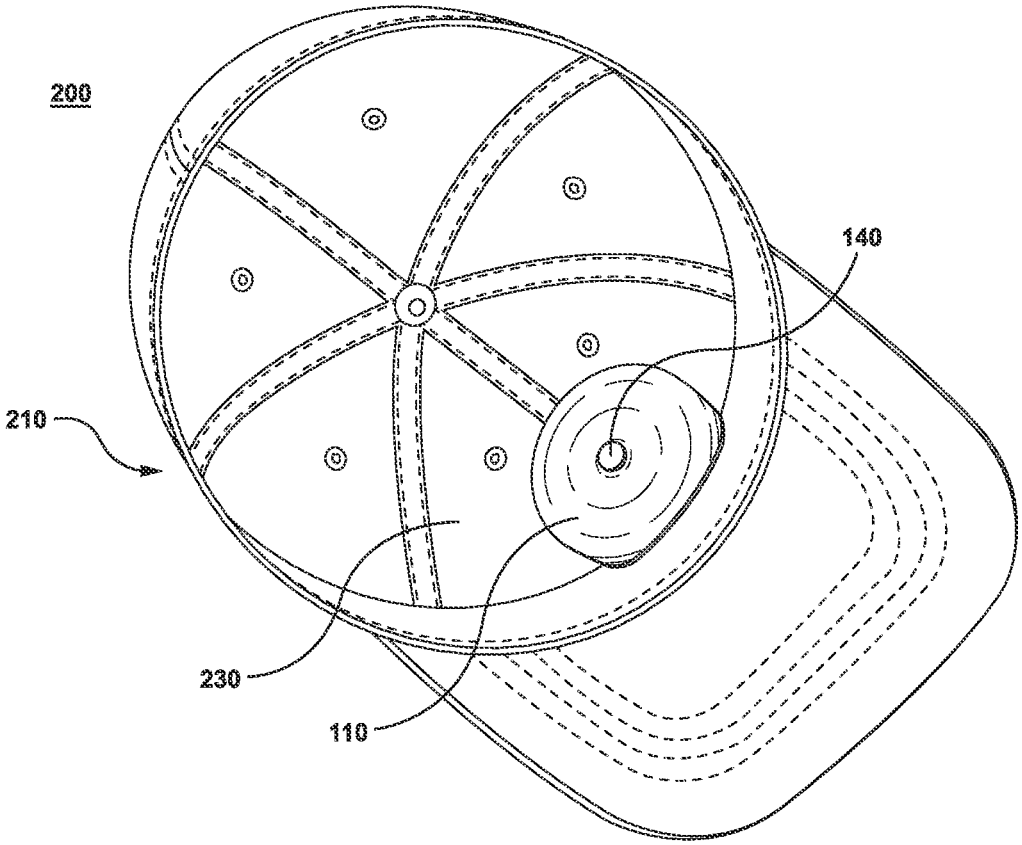
FIG. 5 is a bottom view of the hat employing the device of FIG. 1, according to a non-limiting embodiment.

The base component 110 is attached to the inner surface of the hat 200 provides the required support from inside for the curved component 130. For example, as described above, when the curved component 130 changes from a disengaged state to an engaged state on application of pressure to attach the patch to the hat 200, the base component 110 does not deform or invert in response to the impact. Similarly, when the curved component 130 changes from an engaged state to a disengaged state on application of pressure to receive the patch and attach it to the hat 200, the base component 110 does not deform or invert in response to the impact. The base component 110 thus protects the hat 200 from being deformed when the curved component 130 is switched between the engaged and disengaged states. For example, FIG. 5 shows a bottom view of the hat 200. The bottom view of the hat 200 includes an inner surface 230, base component 110, connector 140. The base component 110 is designed to match the inner curvature of the hat 200. For different articles, the base component 110 is designed to match the profile of the article to which it is attached. For example, for flat surfaces, the base component 110 is designed to be flat shaped.

In some embodiments, a sleeve (not shown) may be utilized to secure the base component 110 to the inside of the hat 200. The base component 110 is partly covered inside the sleeve. The sleeve allows the base component 110 to remain in position when secured to the inside of the hat 200. In some examples, the sleeve may be formed of an elasticized material to allow it to be stretched to receive the base component 110 and to maintain the base component 110 in position against the inner surface of the hat 200.

Figure 12:
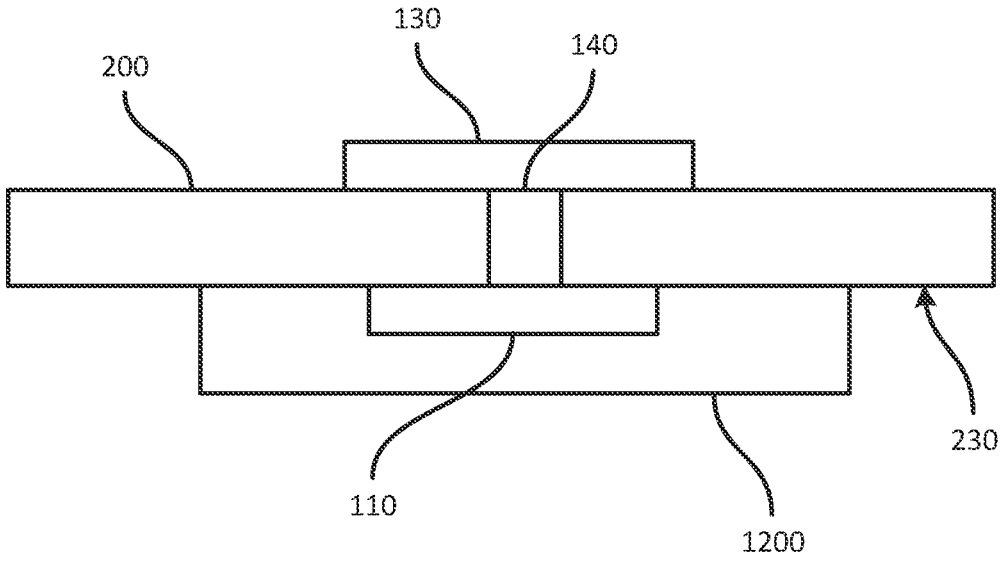
FIG. 12 is a block diagram of the device of FIG. 1.

In some embodiments, the inner surface 230 further comprises a layer of fabric (shown as fabric 1200 in a block diagram in FIG. 12, which will be understood to be schematic only to illustrate the relationship of fabric 1200 with the other components) to cover the base component 110. This prevents the base component 110 from touching the head of the user and allows for additional comfort. The fabric layer is sized to cover the base component 110 on the inside of the hat 200 so that the base component can be inserted and removed. The fabric layer may include a releasable closure (e.g. a hook and loop closure, a button, a snap, or the like) to allow the base component 110 to be inserted and removed.

In specific embodiments, the inner layer of the hat 200 further includes a buckram layer used to define the shape of the hat 200.

Figure 6:
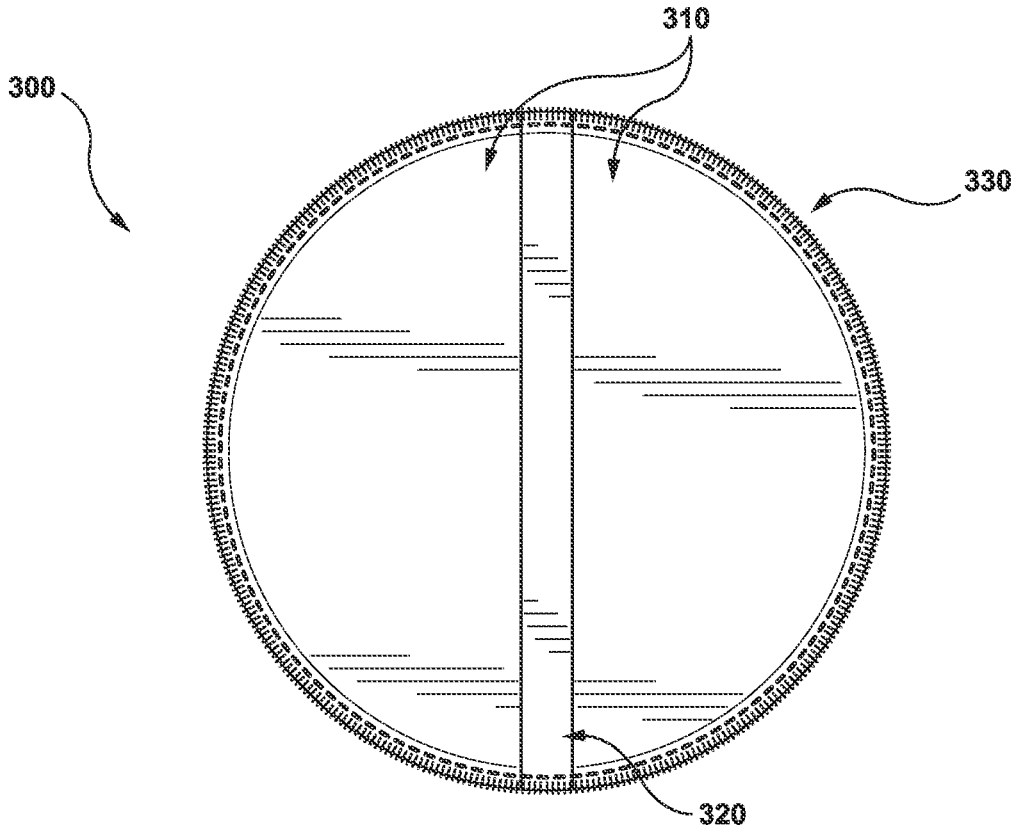
FIG. 6 is a rear view of a patch, according to a non-limiting embodiment.
Figure 7:
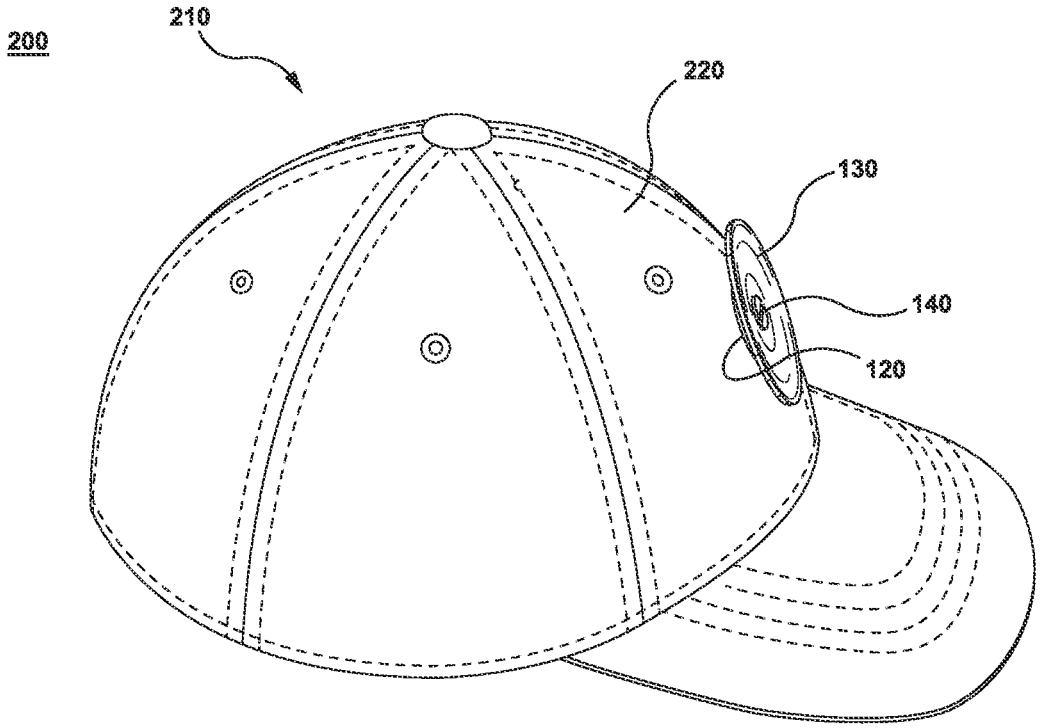
FIG. 7 is a side view of a hat employing the device of FIG. 1 with the curved component in disengaged state, according to a non-limiting embodiment.

FIG. 6 shows an example of a rear view of a patch 300. The patch 300 has a front side including an aesthetic element to be applied to the hat 200. For example, the aesthetic element can include artwork, a logo, an emblem, or the like. The patch 300 further includes a rear side having a sleeve 310 to slide the patch 300 on the curved component 130. The sleeve 310 is sewn to the underside of the patch leaving a small gap 320 through which the patch 300 is received on the curved component 130.

The sleeve 310 may be pulled apart to slide onto the edges of the curved component 130. The sleeve 310 gets trapped between the curved component and base component when the curved component is in the engaged position and helps retain the patch 300 on the article. The shape of the curved component 130 matches the shape of the patch 300 to fit appropriately.

In some embodiments, the patch 300 includes an embroidered edge 330 extending below the sleeve 310 to cover a gap between the front of the hat and the edge of the patch 300 when patch 300 is deployed on the curved component 130.

In operation, to attach a patch to the hat 200 shown in FIG. 3 wherein the curved component is in engaged state, a user may apply pressure to the curved component 130 to move it to its disengaged state. For example, FIG. shows a side view of the hat 200 employing the device 100 wherein the curved component 130 is in the disengaged state.

In the disengaged state, the edges of the curved component 130 project away from the base component 110. In the present example, since the base component 110 corresponds to the curvature of the body 210 of the hat 200, the curved component 130 projects in a direction opposite to the outer surface 220 of the hat 200. In the disengaged state, the curved component 130 can receive the patch (not shown) to be attached to the hat 200.

Figure 8:
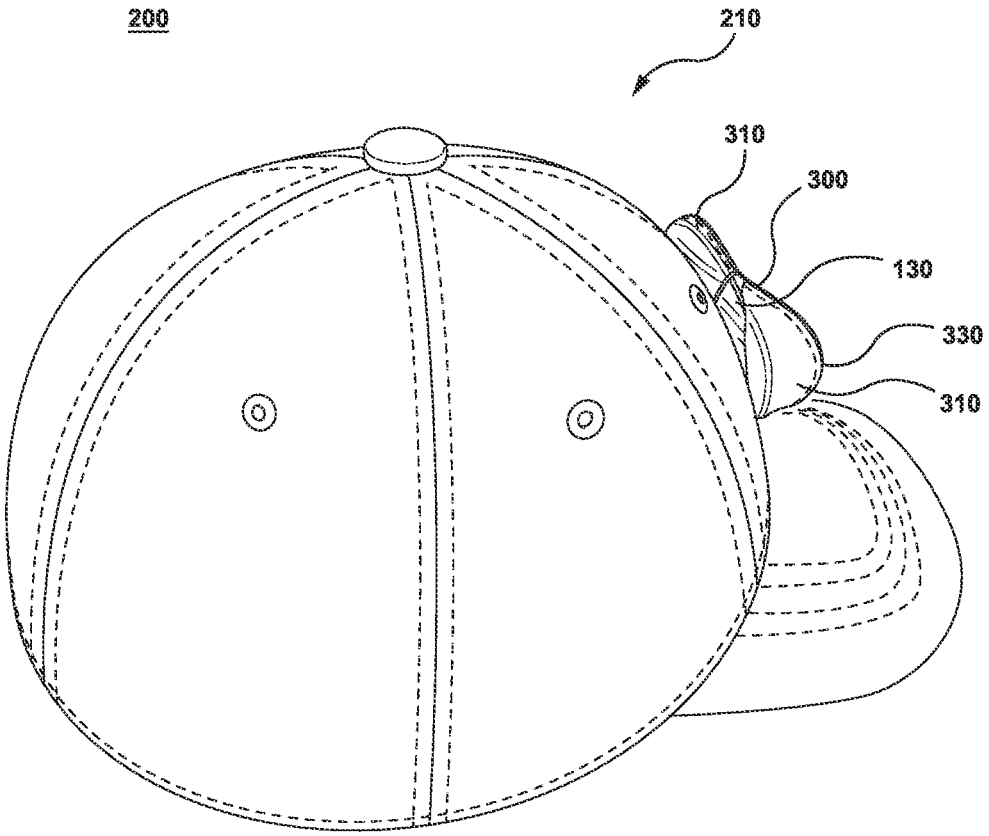
FIG. 8 is a side view of the hat with the patch partially attached to the curved component in disengaged state, according to a non-limiting embodiment.

The user may then attach the patch 300 to the curved component 130. The sleeve 310 of the patch 300 may be pulled apart to slide onto the edges of the curved component 130. More specifically, the user may slide a first portion of the sleeve 310 of the patch 300 onto the curved component 130 and stretch a second portion of the sleeve 310 around a remainder of the curved component 130. This is shown in FIG. 8 which is a side view of the patch 300 partially attached to the curved component 130 in the disengaged state. That is, the sleeve 310 is positioned between the curved component 130 and the base component 110.

Figure 9:
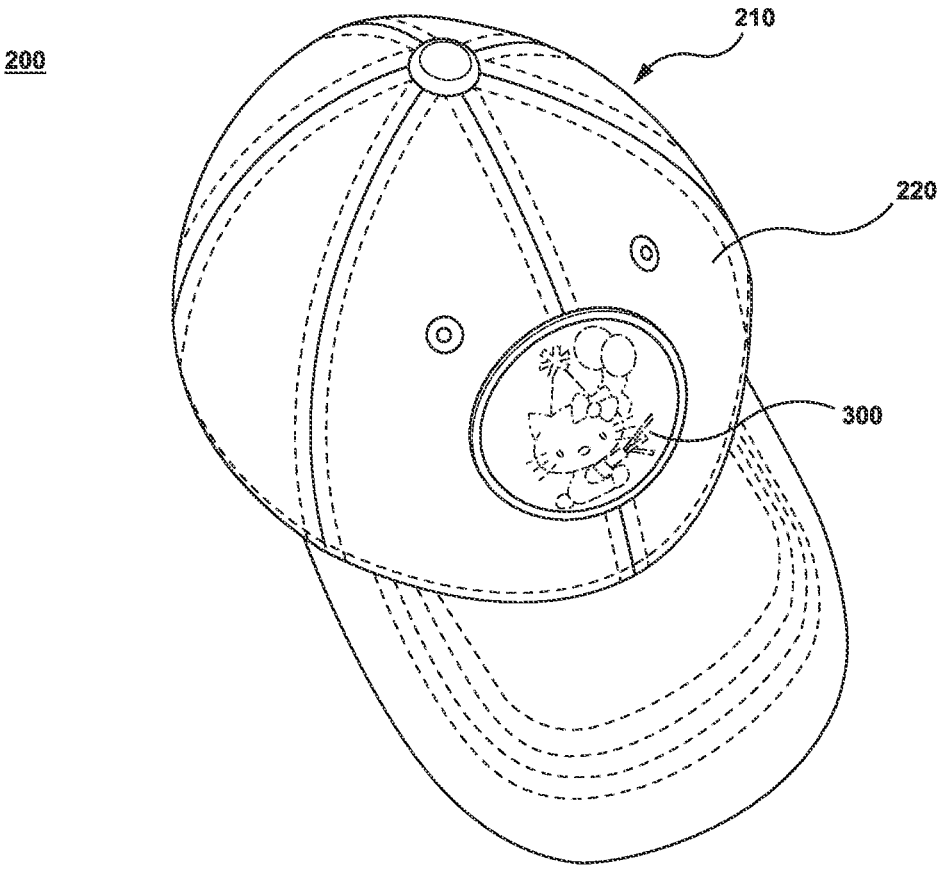
FIG. 9 is a perspective view of the hat with the patch received on the curved component and attached to the article, according to a non-limiting embodiment.

After the patch 300 is received on the curved component 130, the curved component 130 is switched to the engaged state to secure the patch against the outer surface of the body of the hat 200 and retain the patch 300 on the hat 200. The hat 200 is ready to be worn by a user. This is depicted by FIG. 9 which shows a perspective view of the hat 200 with the patch 300.

The patch 300 completely covers the surface of the curved component 130 and its edges rest on the outer surface 220 of the hat 200.

To remove or interchange the patch 300, a user may apply pressure to the curved component 130 to move it to its disengaged state and remove the patch 300 from the curved component 130. The device 100 may then be ready to accept a different patch.

In some embodiments, the device 100 can be used on articles other than hats including, but not limited to, backpacks, lunch boxes, luggage, and purses.

Figure 10:
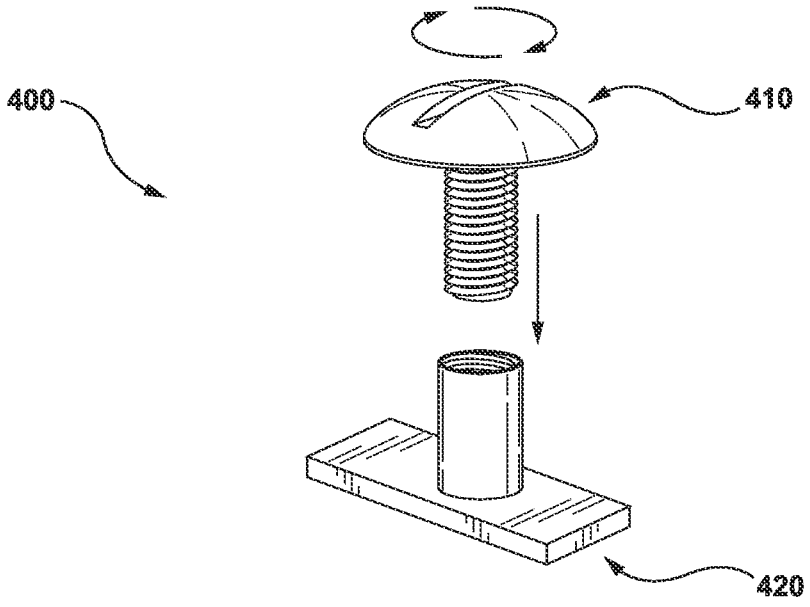
FIG. 10 is an isometric view of the connector of the device of FIG. 1.

FIG. 10 shows an example of a connector 400 of the device of the present invention. The connector includes a male screw piece 410 that engages with a female receiving piece 420. This connector assembly allows the entire device to be easily removed from the article enabling replacement of broken components and/or allowing the use alternate sized curved components to facilitate a greater variety of interchangeable patches.

In an alternate embodiment, the connector may include a spring mechanism for the curved component to extend to the disengaged state enabling the replacement of patch and then pushed back to the natural state to seal the patch to the article. Such design alternatives retail the ease of use and at the same time maintain a high aesthetic standard.

In still further examples, the curved component 130 may be integrally formed with an aesthetic element such that in the absence of a patch attached to the device 100, the article may still present the aesthetic element.

The scope of the claims should not be limited by the embodiments set forth in the above examples but should be given the broadest interpretation consistent with the description as a whole.

The invention claimed is:

1. A device for interchanging a patch on an article, the device comprising:

a base component configured to contact an inner surface of the article;

a curved component configured to contact an outer surface of the article wherein the curved component is switchable between an engaged state and a disengaged state, and wherein the curved component is configured to receive the patch in the disengaged state and attach the patch to the article in the engaged state, wherein the curved component comprises a domed shape having a concave inner side and a convex outer side when in the engaged state, and wherein the curved component is sufficiently stable in the disengaged state to be maintained in the disengaged state; and a connector configured to extend through the article to fasten the curved component to the base component in both the disengaged state and the engaged state.

2. The device as claimed in claim 1, wherein the curved component is aligned with a natural curvature of the curved component in the engaged state and the curved component is inverted against the natural curvature of the curved component in the disengaged state.

3. The device as claimed in claim 1, wherein the connector is configured to releasably fasten the curved component and base component.

4. The device as claimed in claim 1, wherein the curved component is further configured to release the patch in the disengaged state.

5. The device as claimed in claim 1, wherein the base component has a profile selected from a curved or a flat surface.

6. The device as claimed in claim 1, wherein the curved component has a defined shape.

7. The device as claimed in claim 1, further comprising a spacer to space the base component and the curved component at a predefined distance.

8. The device as claimed in claim 1, wherein the curved component has a middle region and the base component has a respective middle region, wherein the connector is located in the middle region of each of the curved component and the base component.

9. The device as claimed in claim 1, wherein when the curved component is in the engaged state, the connector biases an outer edge of the curved component against the base component.

10. An article comprising:

a body having an inner surface and an outer surface;

a patch; and a device to interchangeably secure the patch against the outer surface of the body, the device comprising:

(i) a base component in contact with the inner surface of the body;

(ii) a curved component, wherein the curved component is switchable between an engaged state and a disengaged state, wherein the curved component is in contact with the outer surface of the body when in the engaged state, and wherein the curved component is configured to receive the patch in the disengaged state and attach the patch onto the body of the article in the engaged state, wherein the curved comprises a domed shape having a concave inner side and a convex outer side when in the engaged state, and wherein the curved component is sufficiently stable in the disengaged state to be maintained in the disengaged state; and (iii) a connector extending through the body of the article to fasten the curved component to the base component in both the disengaged state and the engaged state.

11. The article as claimed in claim 10, wherein the curved component is aligned with a natural curvature of the curved component in the engaged state and the curved component is inverted against the natural curvature of the curved component in the disengaged state.

12. The article as claimed in claim 10, wherein the connector is configured to releasably fasten the curved component and base component.

13. The article as claimed in claim 10, wherein the curved component is further configured to release the patch in the disengaged state.

14. The article as claimed in claim 10, wherein the body of the article has a profile selected from a curved and a flat surface and the base component has a profile which is configured to match the profile of the body of the article.

15. The article as claimed in claim 10, wherein the patch has a defined shape and the curved component is configured to match the defined shape of the patch.

16. The article as claimed in claim 10, wherein the body further comprises an aperture for the connector to extend through.

17. The article as claimed in claim 16, wherein the device further comprises a spacer which fits the aperture of the body.

18. The article as claimed in claim 10, wherein the patch comprises a sleeve attached to an underside of the patch to slide the patch on the curved component.

19. The article as claimed in claim 10, wherein the inner surface of the body comprises a layer of fabric to cover the base component of the device.

* * * * *